US006036571A

United States Patent [19]

Chang

[11] Patent Number: 6,036,571

[45] Date of Patent: Mar. 14, 2000

[54] ORNAMENTAL DISPLAY TOY WITH LEAKAGE-PROOF ARRANGEMENT

[76] Inventor: Chao Chang Chang, Ho Keng Village, Ping Ti Liu Lien, Lung Kang District, Shen Chun City, Kwangtung, China

[21] Appl. No.: 09/196,883

[22] Filed: Nov. 20, 1998

[51] Int. Cl.[7] ..... A63H 23/00

[52] U.S. Cl. ..... 446/153; 40/410

[58] Field of Search ..... 40/410, 411, 409, 40/406; 446/153

[56] References Cited

U.S. PATENT DOCUMENTS 5,456,031 10/1995 Hou ..... 40/410

*Primary Examiner*—Robert A. Hafer

*Assistant Examiner*—Urszula M. Cegielnik

*Attorney, Agent, or Firm*—Pro-Techtor International Services

[57] ABSTRACT

An ornamental display toy includes a base, a spherical shell supported on the base, the spherical shell having a neck press-fitted into a circular recess at the base, a sealing cap sealed to the neck of the spherical shell to close the mouth of the neck, a mount mounted on a recessed circular top wall of the sealing cap and spaced from the top wall of the sealing cap by a gap to hold an ornament in a liquid inside the spherical shell.

2 Claims, 5 Drawing Sheets

ORNAMENTAL DISPLAY TOY WITH LEAKAGE-PROOF ARRANGEMENT

BACKGROUND OF THE INVENTION

The present invention relates to an ornamental display toy, and more particularly to such an ornamental display toy that holds a transparent spherical shell, a liquid in the transparent spherical shell, and an ornamental item in the liquid.

FIGS. 1 and 2 illustrate an ornamental display toy according to the prior art. This structure of ornamental display toy 10 comprises a hollow base 15, a transparent spherical shell 13 mounted on the hollow base 15, the transparent spherical shell 13 having a neck 14 embedded in the hollow base 15, a sealing cap 12 sealed to the neck 14 to close the mouth of the neck 14 and supported on the hollow base 15, a liquid 16 held in the transparent spherical shell 13, an ornamental device for example a toy house 11 mounted on the sealing cap 12 and dipped in the liquid 16 inside the transparent spherical shell 13, and light reflecting chips 17 received in the liquid 16 inside the transparent spherical shell 13. When the ornamental display toy 10 is vibrated or shaken gently with the hand and then put on a flat surface, the light reflecting chips 17 are forced to float in the liquid 16, and then to fall to the bottom side (the sealing cap 12) in the transparent spherical shell 13 like the falling of snowflakes. A musical box may be mounted in the hollow base 15. The musical box plays certain tunes in a mechanical manner. For example, a driving mechanism (clockwork) is driven by a handle to turn a pinned barrel (reproducer) over the metal reeds of a metal comb, causing certain tunes to be produced. The aforesaid structure of ornamental display toy still has drawbacks. When the liquid 16 freezes over, its volume expands, causing the sealing cap 12 to be deformed (see FIG. 3). If the sealing cap 12 is deformed, a gap 19 occurs between the sealing cap 12 and the neck 14 of the transparent spherical shell 13. When the liquid 16 returns from the solid state to the liquid state, it immediately leaks out through the gap 19, and at the same time outside air leaks in through the gap 19, causing bubbles to be produced in the remaining liquid 16 inside the transparent spherical shell 13. In order to prevent this problem, anti-freezing agent may be put in the liquid to stop the liquid from being changed into a solid state. However, because anti-freezing agent is expensive, the use of anti-freezing agent greatly increases the cost of the ornamental display toy. Further, because the liquid is treated through a chemical treatment or added with antiseptic, it causes a damage to the environment or human body when leaks out.

SUMMARY OF THE INVENTION

The present invention has been accomplished to provide an ornamental display toy which eliminates the aforesaid problems. The ornamental display toy comprises a base having an annular inside wall defining a circular recess; a transparent spherical shell supported on the base, the transparent spherical shell having a neck press-fitted into the circular recess of the base; a sealing cap sealed to the neck of the transparent spherical shell to close the mouth, the sealing cap comprising a top wall suspended in the neck of the transparent spherical shell, a peripheral wall axially backwardly extended from the periphery of the top wall and press-fitted into the neck of the transparent spherical shell, and a plurality of recessed plug holes at the top wall; a liquid filled in the transparent spherical shell; an ornament disposed in the transparent spherical shell under the liquid; and a mount mounted on the sealing cap and spaced from the top wall of the sealing cap by a gap to hold the ornament in the liquid inside the transparent spherical shell, the mounting comprising a plurality of bottom legs respectively partially press-fitted into the recessed plug holes at the top wall of the seal cap.

DETAILED DESCRIPTION OF THE PREFERRED EMBODIMENT

Figure 1:
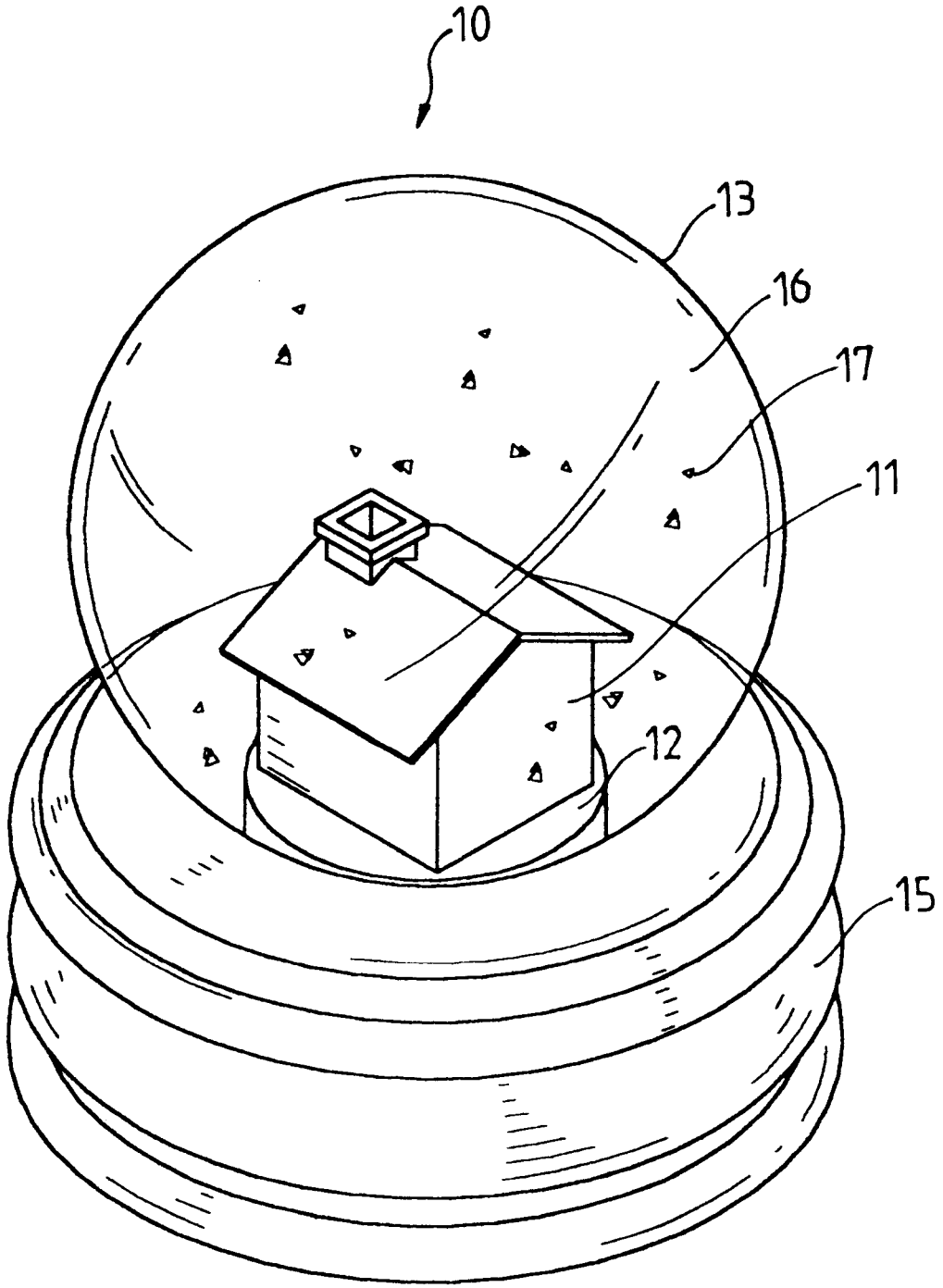
FIG. 1 (Prior Art)
FIG. 1 is a perspective view of an ornamental display toy according to the prior art.
Figure 2:
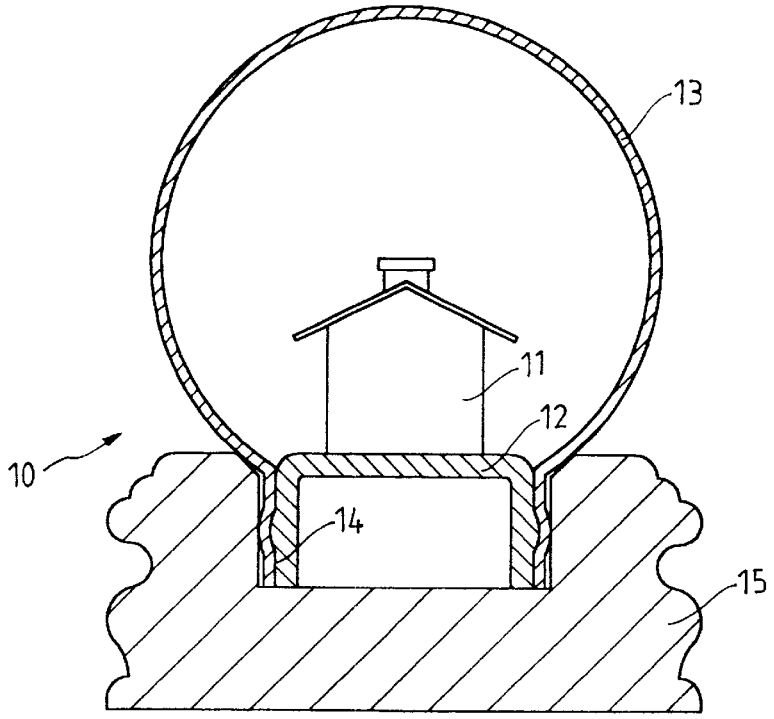
FIG. 2 (Prior Art)
FIG. 2 is a sectional view of the ornamental display toy shown in FIG. 1.
Figure 3:
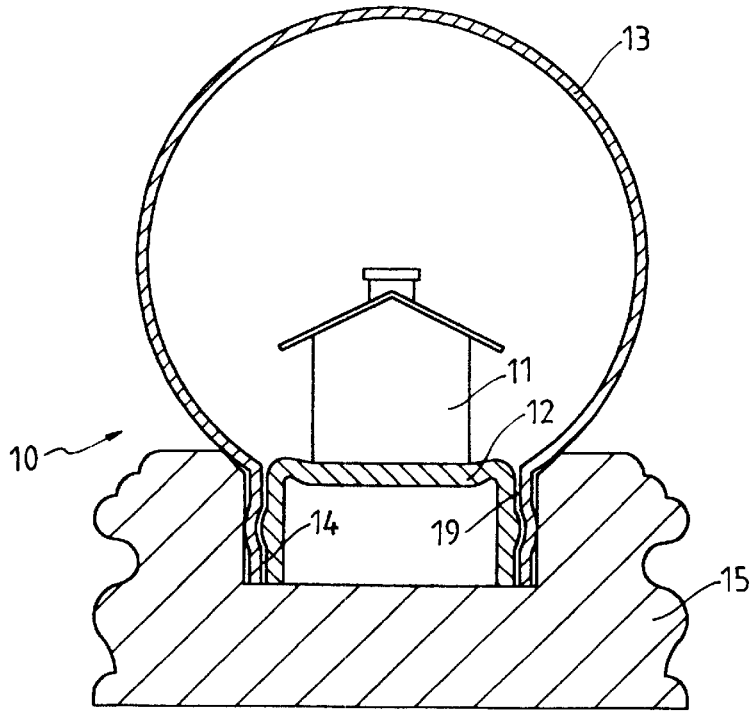
FIG. 3 (Prior Art)
FIG. 3 is similar to FIG. 2 but showing the sealing cap deformed, a gap appeared between the sealing cap and the neck of the transparent spherical shell.
Figure 4:
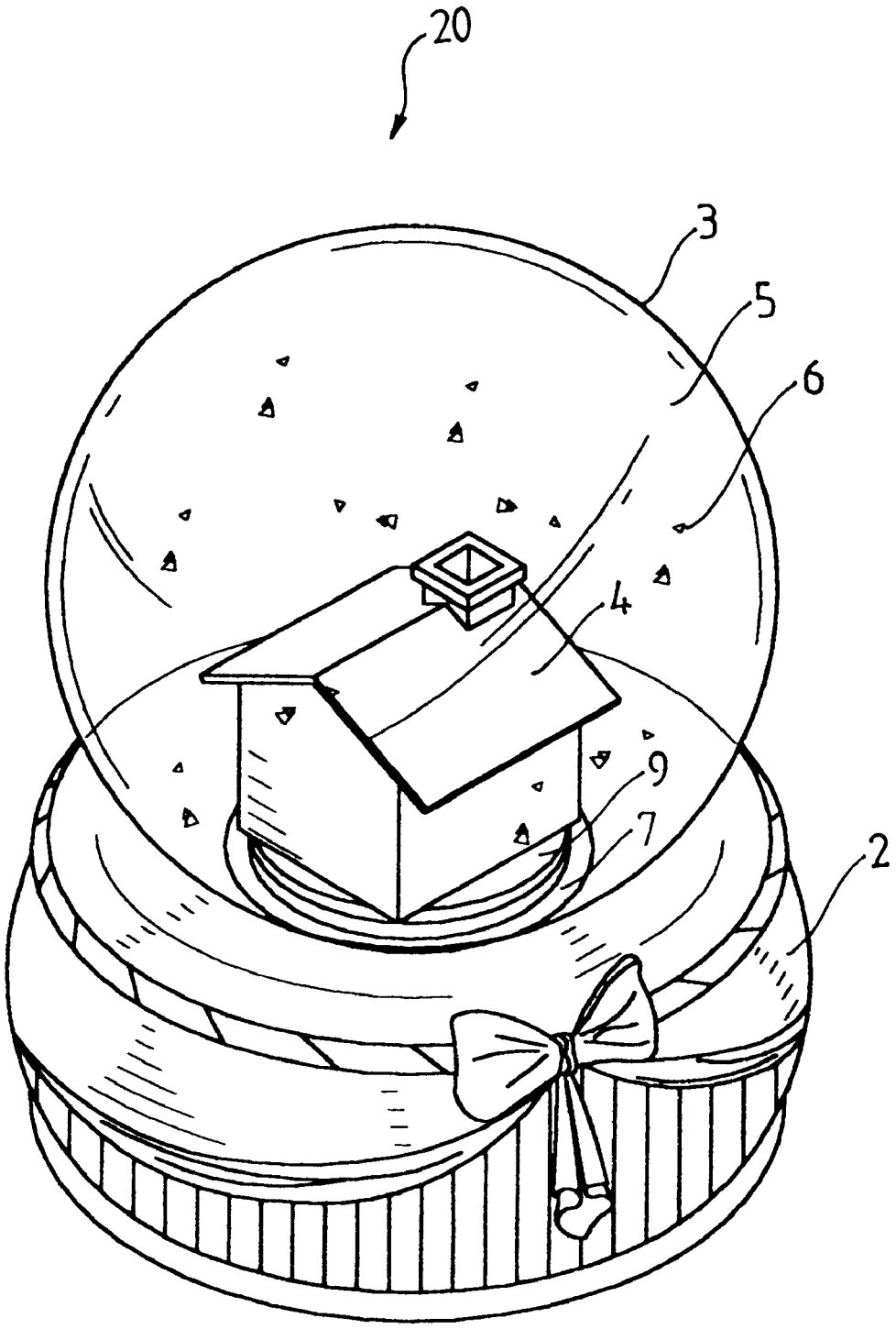
FIG. 4 is a perspective view of an ornamental display toy according to the present invention.
Figure 5:
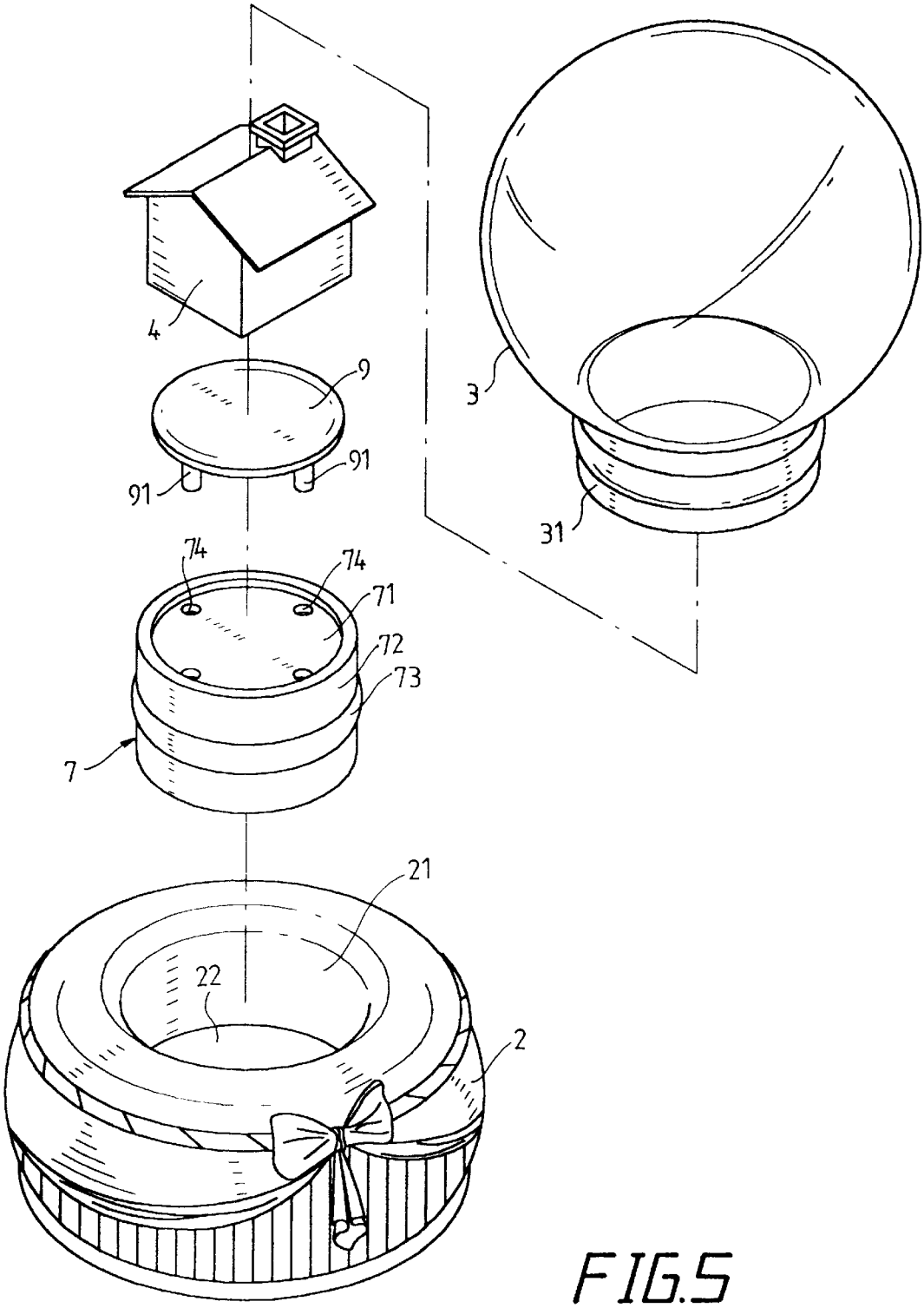
FIG. 5 is an exploded view of the ornamental display toy shown in FIG. 4.

Referring to FIGS. 4 and 5, an ornamental display toy 20 is shown comprised of a base 2, and a spherical shell 3 supported on the base 2. The base 2 comprises an annular inside wall 21 defining circular recess 22. The spherical shell 3 is made of glass, or transparent material such as transparent plastics. The inside space of the spherical shell 3 is filled up with a liquid 5. A fixed ornament 4 is mounted in the spherical shell 3 under the liquid 5. The fixed ornament 4 can be a toy animal, a toy figure, a toy plant, etc. According to the present preferred embodiment, the fixed ornament 4 is a toy house. Movable ornaments for example light reflecting chips 6 are put in the liquid 5 inside the spherical shell 3. When the ornamental display toy 20 is shaken gently with the hand and then put on a flat surface, the light reflecting chips 6 are forced to float in the liquid 5, and then to fall to the bottom side in the transparent spherical shell 3 like the falling of snowflakes.

Figure 6:
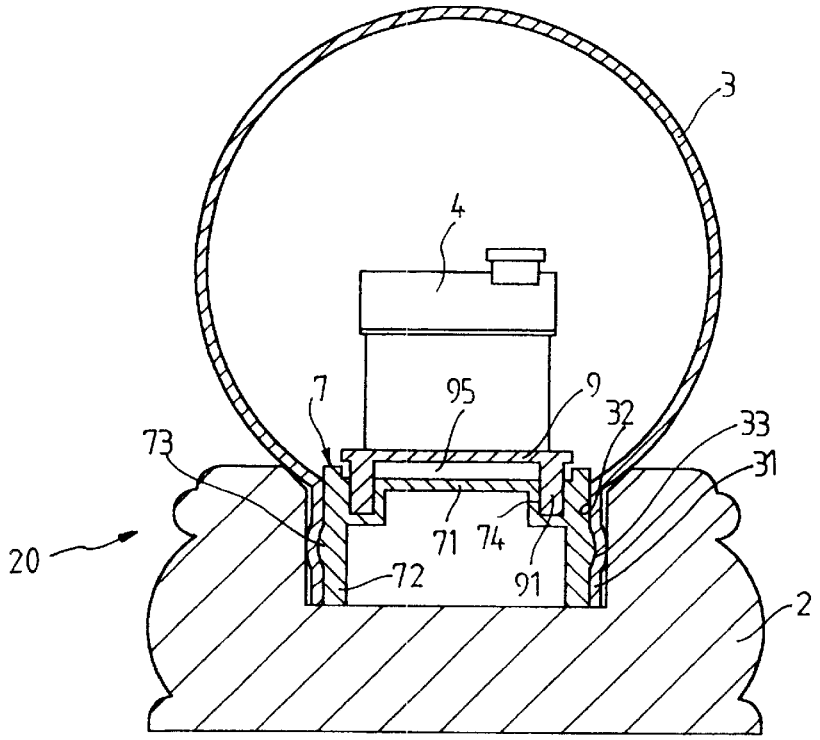
FIG. 6 is a sectional view of the ornamental display toy shown in FIG. 4.

Referring to FIG. 6 and FIG. 5 again, the spherical shell 3 has a downward neck 31 press-fitted into the circular recess 22 of the base 2. The neck 31 defines a mouth 32. The liquid 5 is filled in the spherical shell 3 through the mouth 32. After filling of the liquid 5, the mouth 32 is sealed with a sealing cap 7 to stop the liquid 5 from leaking out.

Referring to FIGS. 5 and 6 again, the neck 31 of the spherical shell 3 has an inside annular groove 33 around its inside wall. The sealing cap 7 comprises a recessed circular top wall 71, a peripheral wall 72 axially backwardly extended from the periphery of the recessed circular top wall 71 and press-fitted into the neck 31 of the spherical shell 3, an annular locating flange 73 raised around the peripheral wall 72 and engaged into the inside annular groove 33 of the neck 31, and a plurality of recessed plug holes 74 at the recessed circular top wall 71. A mount 9 is mounted on the recessed circular top wall 71 of the sealing cap 7 to hold the fixed ornament 4 in the spherical shell 3. The mount 9 has a circular shape, and a plurality of bottom mounting legs 91 respectively press-fitted into the recessed plug holes 74 at the recessed circular top wall 71 of the sealing cap 7. When installed, the mount 9 is spaced above the recessed circular top wall 71 of the sealing cap 7 by a gap 95. The fixed ornament 4 is fixedly fastened to the mount 9 by a bonding agent.

Figure 7:
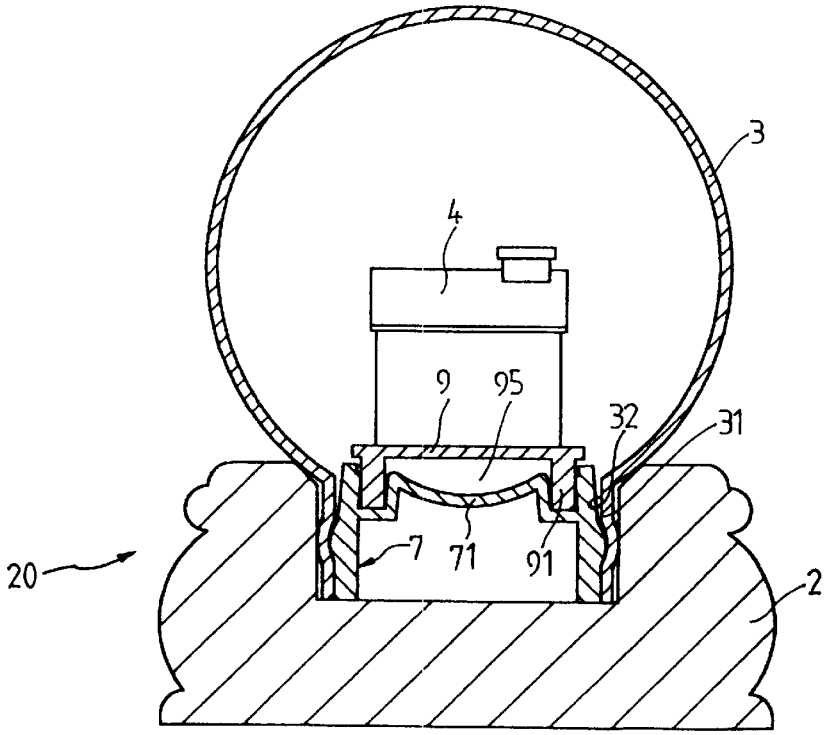
FIG. 7 is similar to FIG. 6 but showing the recessed circular top wall of the sealing cap deformed and curved inwards.

Referring to FIG. 7, when the liquid 5 freezes over, the recessed circular top wall 71 of the sealing cap 7 is forced to curve inwards. When the liquid 5 returns from the solid state to the liquid state, the recessed circular top wall 71 of the sealing cap 7 immediately returns to its former shape. Because of the existence of the gap 95 between the recessed circular top wall 71 of the sealing cap 7 and the mount 9, the changing of shape of the recessed circular top wall 71 of the sealing cap 7 is not hindered.

While only one embodiment of the present invention has been shown and described, it will be understood that various modifications and changes could be made thereunto without departing from the spirit and scope of the invention disclosed.

What the invention claimed is:

1. An ornamental display toy comprising:

a base having an annular inside wall defining a circular recess;

a transparent spherical shell supported on said base, said transparent spherical shell having a neck press-fitted into said circular recess of said base;

a sealing cap sealed to the neck of said transparent spherical shell to close a mouth of said transparent spherical shell;

a liquid that fills said transparent spherical shell; and an ornament disposed in said transparent spherical shell in said liquid;

wherein said sealing cap comprises a top wall suspended in the neck of said transparent spherical shell, a peripheral wall axially backwardly extended from the periphery of said top wall and press-fitted into the neck of said transparent spherical shell and a plurality of recessed plug holes at said top wall; a mount is mounted on said sealing cap and spaced from the top wall of said sealing cap by a gap to hold said ornament in said liquid inside said transparent spherical shell, said mount comprising a plurality of bottom legs each partially press-fitted into a corresponding one of the recessed plug holes at said top wall of said seal cap.

2. The ornamental display toy of claim 1 wherein the top wall of said sealing cap is a recessed circular wall.

* * * * *